US006789645B1

(12) United States Patent
Deblander

(10) Patent No.: US 6,789,645 B1
(45) Date of Patent: Sep. 14, 2004

(54) SOUND-INSULATING SANDWICH ELEMENT

(75) Inventor: Jean-Phillippe Deblander, Strasbourg (FR)

(73) Assignee: The Dow Chemical Company, Midland, MI (US)

( * ) Notice: Subject to any disclaimer, the term of this patent is extended or adjusted under 35 U.S.C. 154(b) by 0 days.

(21) Appl. No.: 09/979,814

(22) PCT Filed: Jun. 18, 1999

(86) PCT No.: PCT/US99/13777

§ 371 (c)(1),
(2), (4) Date: Mar. 5, 2002

(87) PCT Pub. No.: WO00/75443

PCT Pub. Date: Dec. 14, 2000

(30) Foreign Application Priority Data

Jun. 9, 1999 (EP) ..... 99111191

(51) Int. Cl.[7] ..... E04B 2/02

(52) U.S. Cl. ..... 181/290; 181/284; 181/288; 181/291

(58) Field of Search ..... 181/284–296; 52/144, 145

(56) References Cited

U.S. PATENT DOCUMENTS

| | | | | |
|---|---|---|---|---|
| 1,867,549 | A | 7/1932 | Brockmeyer | |
| 1,928,034 | A | 9/1933 | Schulstadt | 154/44 |
| 2,840,179 | A | 6/1958 | Junger | 181/33 |
| 3,087,576 | A | 4/1963 | D'Eustachio | 181/33 |
| 3,180,448 | A | 4/1965 | Gary et al. | 181/33 |
| 3,420,023 | A | 1/1969 | Gregori | 52/309 |
| 3,534,829 | A | 10/1970 | Schneider | 181/33 |
| 3,948,347 | A | 4/1976 | Rutledge | 181/33 G |
| 4,317,503 | A | 3/1982 | Söderquist et al. | 181/290 |
| 4,552,904 | A | 11/1985 | Kadota et al. | 521/145 |
| 4,753,841 | A | 6/1988 | Noel et al. | 428/174 |

(List continued on next page.)

FOREIGN PATENT DOCUMENTS

| | | | |
|---|---|---|---|
| DE | 2231387 | 1/1974 | E04B/2/72 |
| DE | 3710057 | 12/1988 | E04B/2/72 |

(List continued on next page.)

OTHER PUBLICATIONS

Technical Specifications from manufacturers of modular wall (2) Versions with sheeting of gypsum board or chipboard, Plafond & Wand INFO, Nov. 1992 (in Dutch with partial English translation).

*Primary Examiner*—Rina Duda
*Assistant Examiner*—Renata McCloud

(57) ABSTRACT

A multilayered, sound-insulating, mechanically strong sandwich element comprising two facing layers (1) substantially attached to a plastic foam core consisting of at least two layers (2) which are joined through contact points (also called bridges) (3) creating a gap or gaps (4) between the core layers (2), and in case of long spans and/or thin facing layers, travel stops inside the gap/gaps (4) to keep the core layers (2) at a certain distance from each other, wherein the core layer material is a semi-rigid, cellular material containing more tan 50 percent open cells, and has a tensile strength of more than 50 kPa, and has a compressive strength from 5 to 200 kPa, at 10 percent deformation. The distance between the contact points or bridges (3) is at least 350 mm. The new sandwich element can be used as a sound-insulating door, a partition element or a construction unit.

23 Claims, 5 Drawing Sheets

U.S. PATENT DOCUMENTS

| | | | | | |
|---|---|---|---|---|---|
| 4,796,397 | A | | 1/1989 | Capaul | 52/144 |
| 4,838,524 | A | | 6/1989 | McKeown et al. | 256/24 |
| 4,886,696 | A | * | 12/1989 | Bainbridge | 428/184 |
| 4,901,485 | A | | 2/1990 | Menchetti et al. | 52/145 |
| 4,909,003 | A | | 3/1990 | Hennigan | 52/144 |
| 5,030,501 | A | | 7/1991 | Colvin et al. | 428/178 |
| 5,088,576 | A | * | 2/1992 | Potthoff et al. | 181/290 |
| 5,186,996 | A | | 2/1993 | Alts | 428/72 |
| 5,217,771 | A | | 6/1993 | Schmanski et al. | 428/369 |
| 5,459,291 | A | | 10/1995 | Haines et al. | 181/286 |
| 5,493,081 | A | | 2/1996 | Manigold | 181/286 |
| 5,538,779 | A | | 7/1996 | Mispreuve et al. | 428/220 |
| 5,644,872 | A | * | 7/1997 | Perdue | 52/144 |
| 5,923,002 | A | | 7/1999 | MacGrath et al. | 181/290 |
| 6,080,495 | A | * | 6/2000 | Wright | 428/623 |
| 6,158,176 | A | * | 12/2000 | Perdue | 52/144 |

FOREIGN PATENT DOCUMENTS

| | | | | | |
|---|---|---|---|---|---|
| DE | 3940452 | | | 5/1991 | E06B/9/13 |
| DE | 9318446.8 | U | | 3/1994 | B42F/1/02 |
| EP | 171691 | B1 | | 2/1986 | E04B/1/84 |
| EP | 732684 | | | 9/1996 | G10K/11/168 |
| EP | 965701 | | | 12/1999 | B04B/1/86 |
| FR | 2228916 | A1 | | 5/1974 | E04B/1/86 |
| GB | 2027255 | | | 2/1980 | G10K/11/16 |
| JP | 04362697 | A | * | 12/1992 | G10K/11/16 |
| WO | WO 95/14136 | | | 5/1995 | E04B/1/86 |

* cited by examiner

SOUND-INSULATING SANDWICH ELEMENT

CROSS-REFERENCE TO RELATED APPLICATION

This application is a continuation of copending application Ser. No. 09/979,814 filed 5 Mar. 2002, which is a 371 of PCT/US99/13777 filed 18 Jun. 1999.

The present invention refers to sound-insulating sandwich elements, more specifically to sound-insulating multilayered building or construction elements or components such as doors, partitions, walls or ceilings comprising an open-cell, semi-rigid foam core consisting of at least one core material, and comprising one or more than one hollow space or air gap located within the core, and comprising two outer facing layers.

More specifically the invention refers to sound-insulating sandwich elements, such as doors, partition elements, walls, ceilings, floors, bulkheads, fire doors, traps, lids, flaps, windows, compartment elements, or panels in new or existing buildings. The new sandwich elements are useful in buildings, in the construction industry, or other industries in order to improve the sound-insulation performance. Besides, the invention refers to sound-insulating elements excelling prior art elements in constructional simplicity, mechanical strength, and rigidity and to the use of such new, sound-insulating, multilayered sandwich elements in the construction or other industries for acoustically improving walls, partitions, ceilings, and other parts of the building, structure or machinery.

In the construction industry, it is well known to use panels as partition walls in order to subdivide the building area into seperate areas such as rooms and offices. Usuall, they consist of an insulating mineral fiber core and two outer facing layers encompassing the core and an air gap or hollow space. The insulating materials such as mineral fibers are arranged between the facing layers in such a manner so as to provide thermal and/or acoustic insulation.

It is also known to use multilayered sound-insulating sandwich elements, laminates or boards, containing mineral fibers as insulation material, as partition elements or compartment elements or panels to be fixed to walls or ceilings to the intention that sound and noise propagation and transmission and sound radiation are reduced. By applying sound-insulating elements to walls or ceilings or by using them as partition elements it is possible to upgrade residential buildings or office buildings improving their sound-insulation performance. Thus, older constructions can be adjusted to comply with modem often higher regulation standards. Noises from neighbors or external sources or emanating from inside the room can be reduced substantially.

However, a major disadvantage of such partitions or panels having mineral fiber cores is the lack of mechanical strength of such fibers. For that reason the facing layers must be secured, for example, by means of screws or frames, and supported by metal or timber studs. This requires an extensive manufacturing process.

In JA 0221 642, a noise insulating panel is disclosed in which a porous material, such as glass wool or foamed synthetic resin is stacked between facing layers formed by plywood, gypsum board, or an acryl plate in such a manner as to be out of contact with at least one surface material. According to the teaching of this specification, a frame must be used in order to stabilize or fix this condition. This frame is fitted to the above assembly to form a panel. This, of course, is a relatively intricate and hence expensive procedure. Furthermore, it is a well-known method extrapolated from conventional timber frame walls or panels.

DE 3710 057 discloses a multilayered acoustic insulation panel for internal walls which has air gaps between a layer of mineral wool and an outer chipboard facing layer. This insulation panel contains a main panel made of chipboard, which is spaced apart by ribs from a facing layer, or cover panel which is also made of chipboard. The inner surfaces of these two panels are covered with fiberboard which is held in place by glue. For attaining good sound-dampening performance the two fiberboards are different in weight. This multilayered panel consists of five layers, that is, two chipboard layers, each of which is glued to a fiber board, plus a mineral wool layer in the middle of the sandwich serving as acoustic insulation material. The mineral wool fills the space only partly in such a way that an air gap is provided for between the mineral wool and one of the fiberboards which is glued to the inner surface of the cover panel. The latter is secured by screws to the ribs. As can be seen from the description, the design of this multilayered panel is quite complicated. Its fabrication is therefore relatively expensive. The acoustic performance is achieved by increasing the mass rendering such panels difficult to transport and to install.

According to several proposals, organic plastics have been used instead of mineral fibers, such as, for example, the well-known open-cell polyurethane foam laminates. However, such laminates exhibit the disadvantage of being brittle and having a poor tensile strength (about 30 kPa).

In U.S. Pat. No. 4,317,503 a sound-insulating building element is disclosed which includes a plurality of parallel layer elements of which a first inner, thick element is constituted by a layer of mineral fibers or stiff plastic foam and contains a plurality of cavities. A second inner stiff element which is substantially pervious to air is connected to one main surface of the first inner element and an outer impervious element. The outer impervious element is arranged at a small distance from the second inner element in such a manner that substantially the entire outer element can oscillate freely in relation to the second inner element. A major disadvantage of this type of building element is the complex and costly manufacturing process of such multilayered structures.

Other known types of partitions are the multilayered structures including those having a foam or honeycomb core. The foam cores, however, although possessing suitable mechanical strength properties, are very poor as far as the sound-insulating properties are concerned. In order to overcome this problem, the foam core would have to be of an unacceptable thickness and weight.

Generally speaking, there are several known types of systems for increasing the sound-insulation performance of walls such as:

increasing the mass of the wall which is, of course, the most basic way of providing better sound-insulation (mass law);

using resilient panels or sandwich structures the components of which, that is facing layer or layers and core layer, vibrate without phase relation so that part of or most of the incident acoustic energy is converted into mechanical energy, which will be dissipated through internal friction and deformations (mass-spring-mass system).

The drawback of the increase of the mass of the wall or any similar structure following the mass law is that rather heavy and thick structures are required for good performance.

The drawback of common mass-spring-mass systems is that their resonant frequency will very often disturb the overall performance when it is wrongly positioned and too sharp.

Better results are obtained by using sound-insulating elements or panels as disclosed in WO 95/14136. Those multilayered insulating panels or elements comprise in a preferred embodiment (a) two outer facing layers, and (b) a soft synthetic core material which is a single, continuous, soft, synthetic foam core layer having cavities and being arranged in intimate contact with both outer layers through contact points in alternate patterns, thereby providing gaps between the core layer and the opposing outer layer.

What is actually disclosed in the specification, the drawings, the claims and the abstract of WO 95/14136 is the following:

a sandwich element comprising two facing layers, for example, gypsum boards, and a core material between the facing layers;

the core layer comprises an elastic, closed-cell polyethylene foam, or rigid, closed-cell polyurethane foam, or other closed-cell plastic foams, for example, based on polyvinyl chloride, or polystyrene;

the second facing layer can be a brick structure, thus referring indirectly to a wall, to which the core layer can be glued, for example, with mortar;

the core layer contains cavities in special geometrical arrangement; there are gaps between the core layer and the facing layers;

the gaps are confined between the core layer and the facing layers by contact points or areas which are arranged in an alternate pattern with respect to the opposing facings; and empirical measures and theoretical considerations are applied for best results in the mass-spring-mass-system.

Panels as disclosed in WO 95/14136 possess both acoustic insulating properties and mechanical strength. While this art provides lighter and cheaper panels with good acoustic properties compared to previously known products, it was still highly desirable to provide room partition elements and sandwich elements such as doors, and partitions having both sound-insulating properties and good mechanical strength, which would be particularly useful for up-grading residential and office buildings and for designing partitions with improved sound-insulation performance. Also, there was a need for more economical methods for producing and installing such sound-insulating panels.

The previous European Patent Application 98 111 295.6-2303, is directed to a multilayered, sound-insulating panel comprising a facing layer, a plastic foam core layer attached thereto wherein the core layer material is a semi-rigid, cellular material having certain characteristics, a structure, to which the core layer is fixed at seperate contact points by means of strips, patches, dabs, or other geometrical protrusions (generally called "contact points") leaving gaps between the core layer and the structure, and, in case of long spans and/or thin facing layers, travel stops to keep the core layer at a certain distance from the structure.

The panels according to EP 98 111 295.6-2303 are useful in the construction and other industries for improving the sound-insulating properties of buildings and/or machinery.

Although these sandwich elements are in general suitable as partition elements their mechanical strength may not be sufficient due to the presence of the large gap between the facing and the core in application fields where strength and resistance are of particular importance to the applicability of a construction element, such as in the construction of doors or walls.

That need and other needs are met by the present invention. Thus, the present invention provides a multilayered, sound-insulating sandwich element comprising facing layers and a plastic foam core located between the facing layers and attached to the facing layers, the core presenting one or more than one cavities, which sound-insulating element is characterized in that:

the cavity/cavities is/are a gap/gaps which is/are positioned essentially parallel to the facings and is/are located within the core;

the core material is a semi-rigid, cellular material containing more than 50 percent, preferably more than 90 percent open cells;

and has a tensile strength of more than 50 kPa, preferably more than 90 kPa;

and has a compressive strength from 5 to 200 kPa, preferably from 15 to 80 kPa, at 10 percent deformation.

Figure 1:
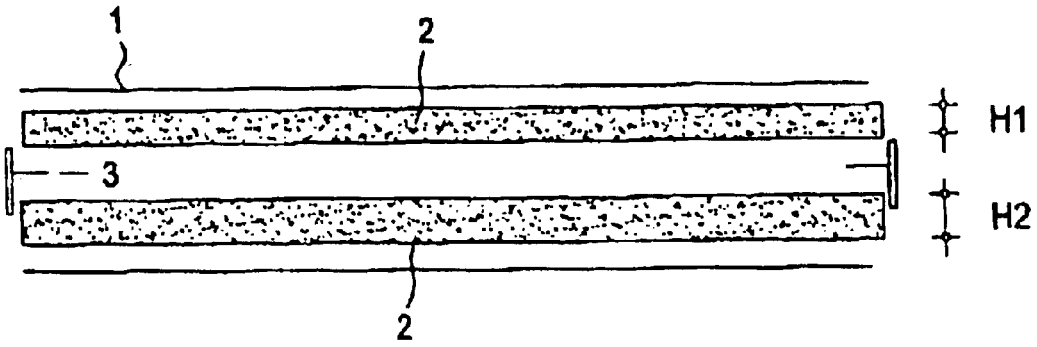
FIG. 1 is a schematic illustration of a sound-insulating sandwich element of a door prior to assembly.

In a preferred embodiment of the invention there is provided a sandwich element wherein the gap or gaps are defined by two core layers and contact points, also called "bridges," providing structural junctions between the core layers while keeping the core layers separated and creating a gap or gaps between the core layers.

The distance between the contact points is preferably at least 350 mm, more preferred is a minimum of 450 mm, or even 600 mm as long as mechanical integrity can be preserved.

The facing layers may have a thickness, each, from 0.5 to 100 mm, preferably from 0.5 to 25 mm. The facing layer material can be a 0.5 to 20 mm thick metal sheet, preferably steel or aluminum, or a 4 to 25 mm thick wood sheet. Other materials, useful in a specific application field, are known to persons skilled in the art.

The foam core layer may have a thickness from 20 to 500 mm, preferably from 20 to 300 mm and even more preferred up to 200 mm. Each foam core layer has in general a minimal thickness of 10 mm to achieve significant dampening, preferably a thickness from 15 to 100 mm. It should be noted, however, that these ranges should not be construed as being restrictive. Values outside these ranges may be suited for particular applications, such as for example, establishments requiring a very high sound-dampening performance.

The foam core layers may or may not have the same thickness. In some cases of facing materials, it has been found beneficial to use different thicknesses so as to minimize the negative effect of the characteristic critical frequencies of the assembly made from the facing and the core layers.

Preferably, the core layer material is a polyurethane foam, for instance of the type whose preparation is disclosed in U.S. Pat. No. 5,538,779.

The core layer material can comprise more than one foam type. For instance, it may include in addition to polyurethane, polyethylene or polystyrene. It may also comprise bitumen or heavy plastic or sheets made of other materials.

In a preferred embodiment the core layer material has an air flow resistivity from 5000 to 800,000 $Ns/m^4$, preferably from 5000 to 300,000 $Ns/m^4$.

The loss factor of the core layer material is preferably greater than 0.1, more preferably greater than 0.2 (as defined by SAE Sound and Heat Insulation Materials Committee, SAE Handbook, 1994, Volume 1, page 2.30); and the loss factor can reach 0.3, or even more.

In the case of long gaps and/or thin facing layers, travel stops are provided at at least one of the core layers and within the gap in order to make sure that the core layers are always kept at a certain distance from each other.

The distance of the travel stops from the opposite core layer or the distance of the core layers from each other, at 0 percent deformation, is preferably at least 0.1 mm, with preferred ranges being between 2 and 10 mm.

In a preferred embodiment the total contact points area is related to the total area of the sandwich element in a ratio of less than 30 percent, preferably less than 15 percent.

In a preferred embodiment the contact points are plastic foam, plastic, metal or wood strips of a thickness of from 0.5 to 100 mm and a width from 10 to 100 mm. These ranges should, however, not be construed as being restrictive and may vary depending upon the specific stress requirement of the application and the stiffness of the facings. Very rigid facings would for instance allow an air gap of unspecified thickness. Protruding parts of the core layers or even other constructional elements, such as door frames, may assume the function of the contact points or "bridges."

Furthermore, the present invention provides a process for the fabrication of the new sound-insulating sandwich element, by attaching the facing layers to the plastic foam core, said process being characterized by the fact that the plastic foam core is produced by joining two core layers through contact points or bridges at predetermined distances, thus leaving a gap or gaps between the core layers, or by first machining two core layers in such a way that contact points or bridges are formed at predetermined distances as integral parts of the core layers and by joining the two core layers afterwards through the contact points or bridges leaving a gap or gaps between the core layers or by cutting out the gap or gaps from a single plastic foam board.

Furthermore, the present invention provides the use of the new sound-insulating sandwich element in the construction and other industries for improving the sound-insulating properties of buildings and/or machinery.

A particularly surprising feature of the invention is that long span vibration of the core layer attached to the facing layer provides particularly good dampening at all frequencies and specifically at the resonant and the critical frequencies.

The gaps created within the foam core can vary considerably depending on the actual needs in a given case. Very rigid facings would allow an air gap of unspecified thickness. The thickness usually ranges from 0.1 to 200 mm. Sometimes the thickness is selected between 20 and 50 mm so as to allow for passing cables, pipes and other service lines. Apart from those special consideration, the thickness of the gaps is often in the range from 1 to 10 mm, more preferably from 2 to 5 mm.

In case of a plasterboard (or a board from any other material insufficiently stiff) being used as facing layer, and if, for example, the plasterboard is 10 mm thick and its span exceeds 400 mm or is 13 mm thick and its span exceeds 600 mm, respectively, a "mid span" travel stop system made of a strip or patches can be installed to limit the plasterboard deformation. By way of example, if a 1200 mm wide plasterboard laminate is installed with contact points (stripes) of 40 mm width at the edges of the board, thereby providing for a free span of 1120 mm, a travel stop stripe will be fixed in the middle of the board in order to reduce the span. The width of the travel stop stripe will be between 30 and 39.9 mm, more preferably between 35 and 38 mm, if the contact stripe width is, for example, 40 mm.

The realization of the invention by adhering to the parameters as defined in the specification and the claims, particularly by using a specific foam material, and applying specific designs with regard to the core layer, the facing layer(s), and the travel stops, will result in a sound-insulating sandwich element showing very low resonant frequency and surprisingly high dampening of vibrations, specifically at the resonant frequency, and having high mechanical strength and rigidity, which means that the new elements can be transported and handled without any particular risk of damage. Therefore, additional reinforcement to ensure mechanical integrity of the assembly, such as by means of screws, frames, or studs, is not necessary.

Nevertheless, other connecting or rigidifying devices can be incorporated, once the components are in place or before the installation, within the element or at the junctions to ensure that the specific requirements of the application are fulfilled. Design arrangements are proposed to prevent any sound bridging to take place while still fulfilling all strength requirements in use. This is known by the person skilled in the art Typical reinforcements will be wood or metal frames for the door application, steel studs or beams between panels for the partition application, and mortar or glue for wall application.

The facing layers can be made of any material typically employed to produce insulating sandwich elements or panels. Exemplary materials useful as facing layers include plastic or particle boards, thick paper or cardboards, fiber boards, gypsum plaster boards, flexible plastic films or foils, metal sheets, such as steel, lead, or aluminum sheets, plywood, timber boards, and chipboards, most typical being gypsum plaster boards, and chipboards. The preferred material for use as facing layer is gypsum board in the partition applications and metal sheet or wood boards in the door applications.

In one embodiment of the invention, a core layer made of polyurethane foam having separated polyurethane foam patches as contact points at one of its two surfaces, is substantially attached by means of adhesives at its "inner" surface to another polyurethane foam core layer, thus forming a core. Usually, such a panel will be prefabricated thereby avoiding assembling on site. The core will then be fixed to the two facing layers, usually by glueing with a suitable adhesive such as polyurethane glue, neoprene contact or transfer adhesive, or by mechanical fixing in order to produce a sandwich element according to the invention.

The sandwich element thus obtained can be used for instance as doors. The facing material for doors usually are thin layers of metal sheet or wood sheets and are substantially attached to the core layers in order to fulfill requirements such as heat stability, impact deformation resistance, perfectly plane surface and aesthetics. It is, therefore, important that no gaps are created between the reinforcing foam core and the facing layers when the latter lack stiffness.

Furthermore, the substantial attachment between facing and core layers, by means of adhesive, for example, provides benefits in so far as the highly dampening core material which is used according to the invention strongly reduces impact and vibration transmission.

The new sandwich element can also be used for instance as a room partition standing on its own. Such a partition element is usually secured on the floor and/or at the ceiling. It can be fixed to a wall, ceiling, floor, or other building structure.

The sandwich partition concept as per the invention concerns space dividing units, mostly for offices, industry cabins and other panel applications where the combination of lightweight, easy connecting devices, handability and sound-insulation performance are important requirements. These partitions may rest in a vertical or horizontal positions but, in some embodiments, they may as well be positioned at acute or obtuse angles.

It was surprising to find that outstanding sound-insulation performance could be achieved by incorporating specific contact points or bridges within the core to create an air gap or air gaps which is therefore a conspicuous feature of the present invention.

The contact points can be machined from the polyurethane foam layer or can be made from other suitable materials, such as plastics other than polyurethane, glue or other adhesives; wood, plaster, or metal, as long as the inventive criteria are fulfilled.

In addition to the door and the partition wall applications of the sandwich element according to the invention, another embodiment of the present invention are panels useful in construction unit applications. Here, the new sandwich elements function like brickstones in a building wall, a ceiling, a floor or any other construction part or unit.

The sound-insulating sandwich elements of the present invention are not only particularly useful for refurbishing existing buildings, but also as elements in new constructions. They can be manufactured as doors or partition elements or wall construction units. They offer a thin, lightweight and mechanically strong solution to improve sound-insulation, thus eliminating or damping sounds and noises which without the sound-insulating elements are transmitted through walls, doors, floors, ceilings and partitions.

On the basis of examples, it will be demonstrated hereafter that the sandwich elements according to the invention, are to a surprising degree substantially superior as compared to prior art sound-insulating elements with respect to a combination of sound-insulation/mechanical strength/lightweight/thickness properties and production/installation methods. They excel in mechanical strength as compared to sound-insulating sandwich elements of the state of the art, possess a high acoustic dampening performance, and reduce and lower the resonant frequency. The gap within the core is acting as a first very soft spring, and the core layers are acting as second hard springs. Because of the hardness of the core layers, the deformation of the element is strongly restricted which makes it compatible with the intended use in buildings.

The following examples are given to illustrate the invention and should not be interpreted as limiting it in any way.

EXAMPLE 1

Figure 2:
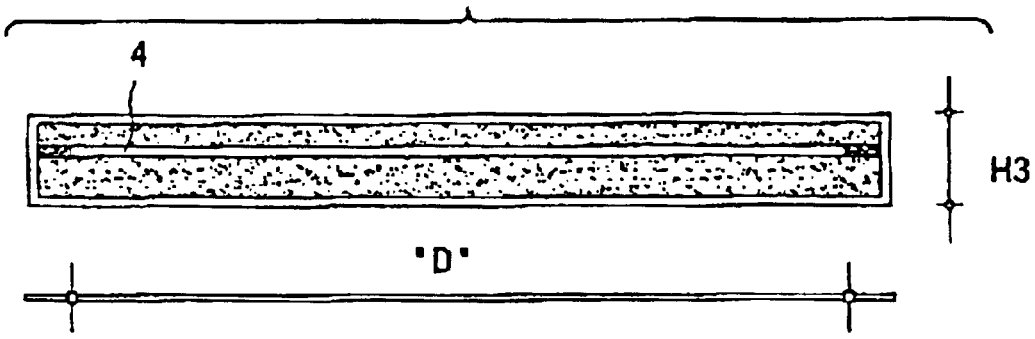
FIG. 2 is a schematic illustration of the element shown in FIG. 1 after assembly.
Figure 3:
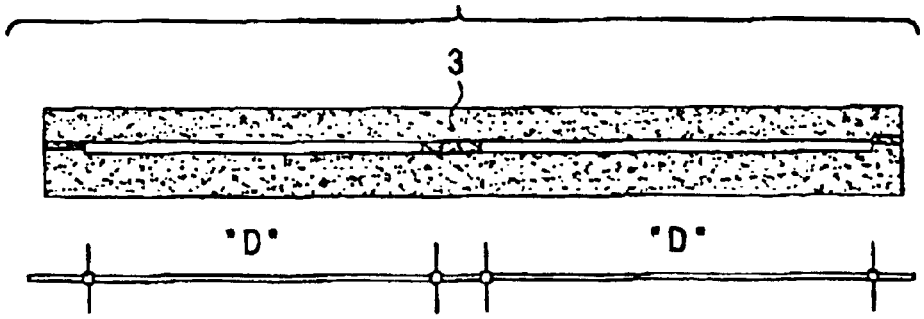
FIG. 3 is a schematic illustration of a variation of the element shown in FIG. 2 that incorporates a third contact point.

The assembly of a sandwich element according to the invention for the application as a door is schematically shown in FIG. 1. The numbers (1) refer to the facing layers, (2) to the core layers and (3) to the contact points which, in this case, are T-shaped. FIGS. 2 and 3 show two sandwich elements after having been assembled, the difference of the element according to FIG. 3 as compared to the element according to FIG. 2 being that a third contact point has been incorporated.

The elements were made from a 20 mm thick polyurethane board and a 40 mm thick polyurethane board (2), wherein said polyurethane had been prepared according to the method described in Example 1 of U.S. Pat. No. 5,538,779, and two 1 mm thick steel sheets (1) by spray-gluing with a contact adhesive (neoprene) at room temperature, one board to one metal sheet and the other board to the second metal sheet, and by joining both assemblies through T-shaped contact points (3), 40 mm wide, and positioned at a distance from each other of 800 mm, as shown in FIG. 2, and through T-shaped contact points (3) and an additional contact point (3') in the center, as shown in FIG. 3, respectively. The contact points are 3 mm thick and 40 mm wide plastic stripes (PE, PU, or PVC, for example).

It will be noted that the two core layers are different in thickness. The reason is that this reduces the negative effect of the characteristic critical frequencies of the facing and the core layers once attached together.

Travel stops might be incorporated as required.

The air gap (4) is characterized by the thickness generated by the contact points (3) and the distance D. The distance D as illustrated In FIG. 2 and FIG. 3 is at least 350 mm, preferably 450 mm or most preferably 600 mm or more as long as mechanical integrity can be preserved.

A door manufactured according to the present invention will achieve excellent dimensional and heat stability with no bowing effect under differential temperature. It will provide thermal insulation and outstanding impact and airborn sound-insulation—better than a classic construction of three times more weight.

With adequate choice of core material thickness and stiffness, excellent planeness and aesthetics will be achieved even with very thin facing materials.

EXAMPLE 2

A door sandwich element according to the invention was built and tested for its acoustical insulation.

Figure 4:
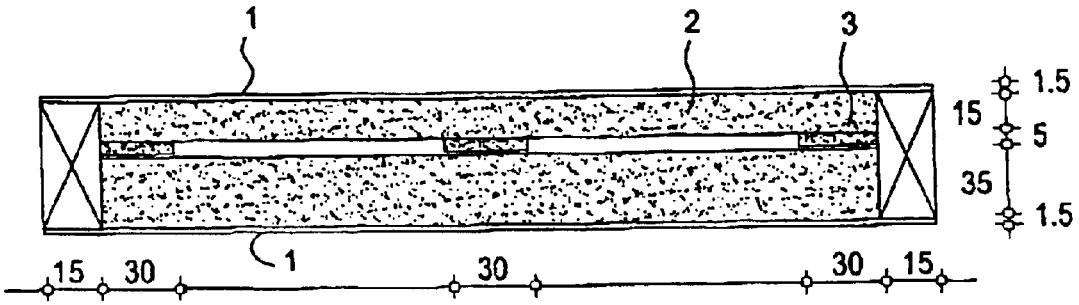
FIG. 4 is a cross-sectional view of a sandwich element of a door wherein the contact points are not glued.

2.1—FIG. 4 illustrates a cross-sectional view and the composition of the tested door with a dimension of 1050 mm by 2050 mm by 55 mm (see also FIG. 1). The facings (1) are 1.5 mm thick steel sheets.

The core material (2) is a noise-insulation foam, as described previously in U.S. Pat. No. 5,538,779, available from The Dow Chemical Company. The top half has a thickness H1 of 15 mm and the bottom half H2 has a thickness of 35 mm.

Contact points (3) are made of a 30 mm wide foam strip of 5 mm thickness and 2050 mm length with a pine timber frame of 15 mm width, 55 mm thickness and running around the four sides of the door panel to provide stiffness and hard edges.

As can be seen from the configuration of FIG. 4, the timber frame is entirely glued with contact neoprene adhesive to both the foam core and the steel facings, while the foam stripes are only laid there to ensure contact between the two halves of core material (2) and are not glued.

The test item has a measured weight of 57 kg, that is, only 26 kg/m$^2$. The total thickness is 58 mm.

Despite its very low weight and reduced thickness, the door element or panel as per the invention, whose cross-section is illustrated in FIG. 4 achieves an amazingly high sound-insulation performance (measured in deci-Bells scale (A) (dB(A)) of Rw=49 dB(A), R pink=47 dB(A) and R road noise=41 dB(A).

None of the available door panels of such weight and thickness comes up with such a level of performance.

This compares for instance to a solid concrete wall of 90 mm thickness, weight 207 kg/m$^2$, that achieves a sound-insulation of R=47 dB.

Figure 5:
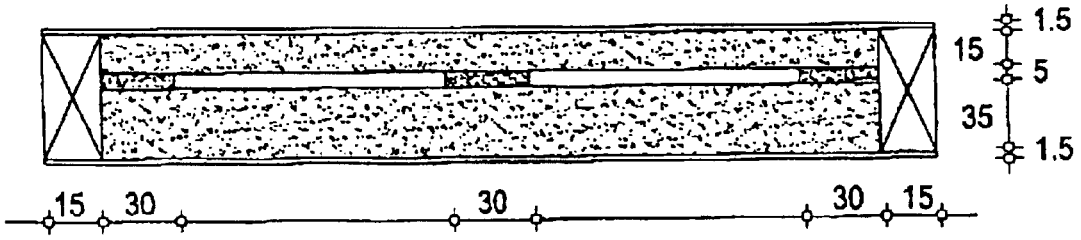
FIG. 5 is a variation of the element shown in FIG. 4 wherein the contact points are adhesively bonded.

2.2—FIG. 5 illustrates the same door cross-section, but for this second test, the contact points stripes (3), both in the center and at the sides, have been glued with contact adhesive to both sides of the core material (2). This attachment method allowed more stiffness on the element.

As expected, the distance D being reduced from 1020 mm (test 1) to 465 mm (test 2) between contact points somewhat affects the sound-insulation performance, which remains very high and is still within the scope of the invention.

Rw=45 dB(A); R pink=44 dB(A), R road noise=37 dB(A).

Figure 6:
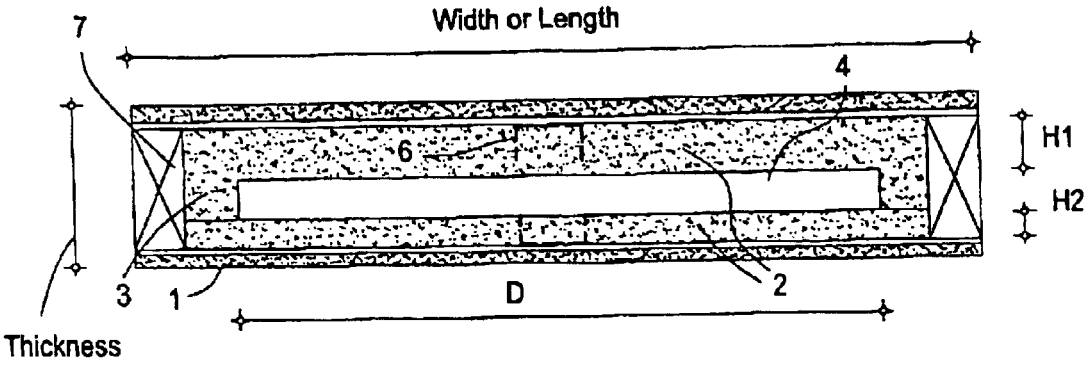
FIG. 6 is a cross-sectional illustration of a sandwich element of a door panel with stiff facings.
Figure 7:
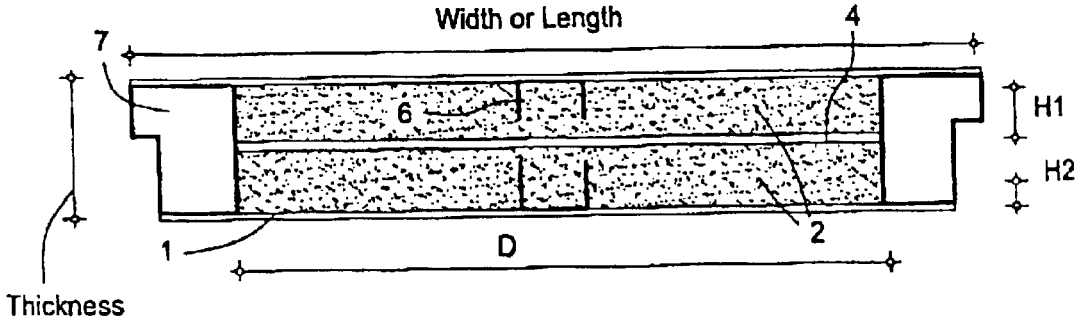
FIG. 7 is a cross-sectional illustration of a sandwich element of a door panel with thin sheet facings and U-profiles that stiffen the facing.

2.3 and 2.4—FIGS. 6 and 7 illustrate improved cross-sections of door panels according to the invention, as suitable for industrialization.

In FIG. 6, the facings (1) are relatively stiff or stiff (plywood planks for instance), therefore the need for reinforcing this type is optional and depends on the span D.

The two halves of the core (the two core layers (2)) have different thicknesses H1 and H2. The contact points (3) leave an air gap (4), and a frame (7) runs around the door panel.

2.4—In FIG. 7 the facings (1) are thin sheets (steel 0.6 mm thick, for instance). Therefore, it is necessary to stiffen the facings by means of U profiles (6) which are welded or glued to the facings.

Since these U shaped profiles (6) are embedded into the foam core, their own vibration pattern is reduced by the strong dampening capacity of the foam core. It must be understood that other shapes like T profiles or any other profiles (from aluminum, steel, plastic, or timber), providing an adequate stiffening effect due to their moment of inertia and specific modulus, are acceptable, too.

The air gap (4) is very thin and is generated by the thickness of the metal frame (7), which in this specific case replaces the strips usually used as contact points (3) and forms abridges between the core layers. The two layers or halves of the core material (2) have the same thickness (H1=H2).

Sometimes, it is more convenient to run the stiffening profile (or profiles) parallel to the width of the sandwich element and not to the height. Diagonal and cross-dispositions are, of course, acceptable as well.

EXAMPLE 3

Figure 8:
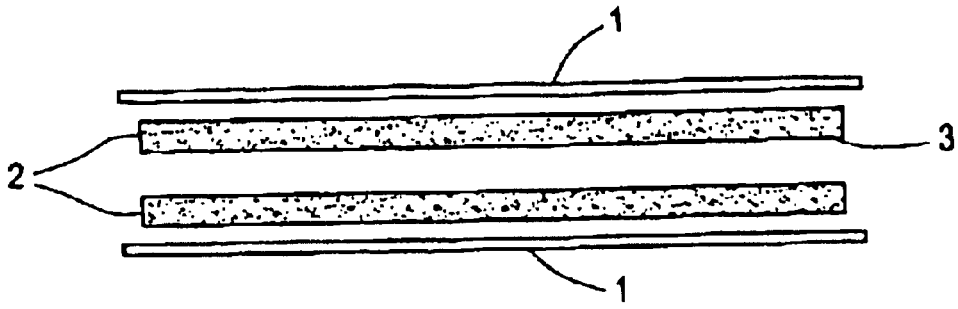
FIG. 8 is a schematic illustration of an assembly of a sandwich element before assembly.
Figure 9:
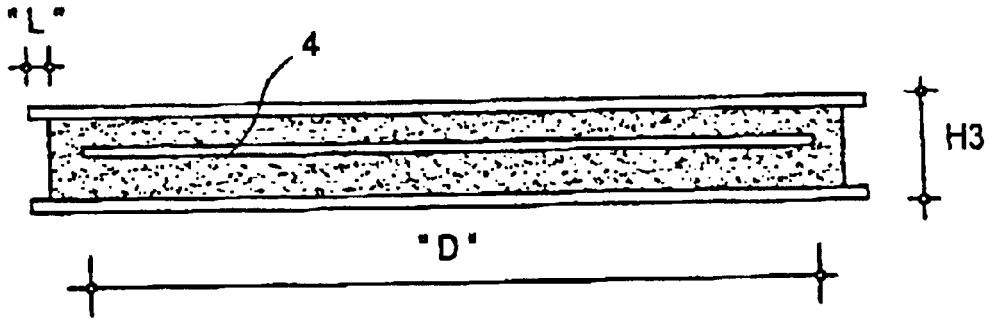
FIG. 9 is a schematic illustration of the sandwich element of FIG. 8 after assembly.

The assembly of a sandwich element according to the invention for the application as a partition element is schematically shown in FIG. 8. The sandwich element, once assembled, is shown in FIG. 9. The numbers (1) refer to the facing layers, (2) to the core layers and (3) to the contact points which, in this case, belong to the core material itself, since the gap (4), 2 mm thick, is machined out of a single board.

These new sandwich elements were made from a 25 mm thick polyurethane (according to U.S. Pat. No. 5,538,779) board (2) and two 15 mm thick wood boards (1) by gluing them together with a neoprene-based contact adhesive. The contact points, forming part of the core body, are 15 mm wide.

Preferably, the gap is not exactly positioned in the center of the panel in order to avoid the accumulated negative effect of similar critical frequencies generated by the two facings when submitted to noise frequencies between approximately 50 Hz and 5000 Hz. In some cases this effect is not detrimental. However, it all depends on the thickness, modulus and dampening factor of the facings.

EXAMPLE 4

Figure 10:
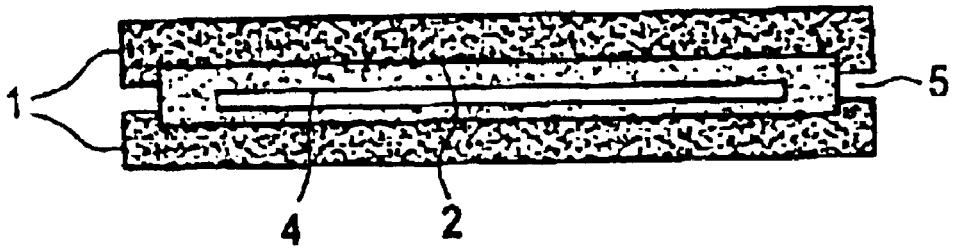
FIG. 10 is a schematic illustration of a sandwich element as part of a construction element that has I-shaped clay-brick facings that encapsulate a core.

In this example, a sandwich element according to the invention to be applied as construction unit is disclosed. With reference to FIG. 10, it is noted that the core of this element is made of two bonded planks of a plastic foam material leaving a gap (4) that is centered or preferably off-centered. The sandwich element has L shaped clay brick facings that encapsulate the core (2). The L shaped facing bricks create a second gap (5) along the vertical edges of the element to provide space for electrical cables. In another embodiment the gap (5) will be used to pour jointing mortar.

Figure 11:
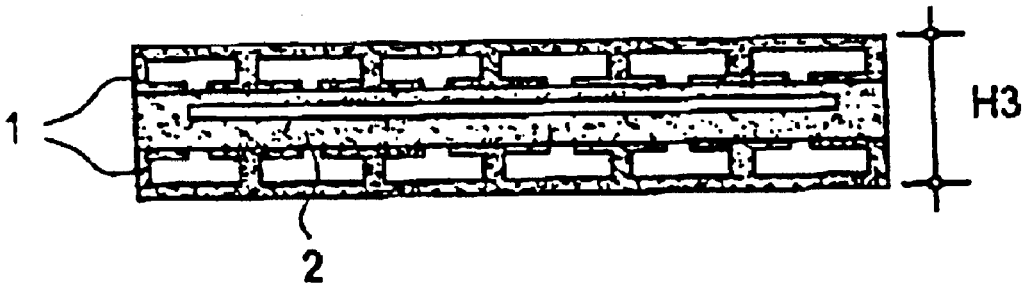
FIG. 11 is a schematic illustration of a sandwich element with hollow brick facings.

Another embodiment of a sandwich element for the application in the construction of walls is demonstrated in FIG. 11. The facings (1) are made of hollow bricks. The cavities within the bricks, for example, slots or round holes, are open towards the core of the element. The rate of perforation is approximately between 10 percent and 80 percent, preferably above 30 percent. This disposition is characteristic of the invention and will allow reduction in the resonace frequency of the mass spring mass system, while providing some sound absorption benefits at the same time.

What is claimed is:

1. A multilayered, sound-insulating sandwich element comprising facing layers and a plastic foam core located between the facing layers and attached to the facing layers, the plastic foam core presenting at least one cavity, characterized in that each cavity is a gap which is positioned parallel to the facings and is located within the core, the core material is a semi-rigid, cellular material containing more than 50 percent open cells and having a tensile strength of more than 50 kPa and a compressive strength from 5 kPa to 200 kPa at 10 percent deformation, wherein each gap is defined by two plastic foam core layers and contact points providing structural junctions between the two plastic foam core layers while keeping the plastic foam core layers separated.

2. The element according to claim 1 wherein the plastic foam core material has more than 90 percent open cells.

3. The element according to claim 1 wherein the plastic foam core material has a tensile strength of more than 90 kPa.

4. The element according to claim 1 wherein the plastic foam core material has a compressive strength from 15 kPa to 80 kPa at 10 percent deformation.

5. The element according to claim 1 wherein the distance between the contact points is at least 350 mm.

6. The element according to claim 5 wherein the distance is at least 450 mm.

7. The element according to claim 5 wherein the distance is at least 600 mm.

8. The element according to claim 1 wherein the plastic foam core layer comprises more than one type of foam.

9. The element according to claim 1 wherein each facing layer has a thickness in the range from 0.5 mm to 200 mm and the plastic foam core layer has a thickness in the range from 20 mm to 200 mm.

10. The element according to claim 1 wherein the plastic foam core layers are different in thickness.

11. The element according to claim 1 wherein the plastic foam core layer material has an air flow resistivity from 5000 $Ns/m^4$ to 300,000 $Ns/m^4$.

12. The element according to claim 1 wherein the plastic foam core layer material has a loss factor of more than 0.2.

13. The element according to claim 1 wherein travel stops are provided at least one of the core layers and within the gap in order to keep the core layers at a certain distance from each other.

14. The element according to claim 13 wherein the distance of the travel stops from the opposite core layer or the distance of the core layers from each other, at 0 percent deformation, ranges from 2 to 10 mm.

15. The element according to claim 1 wherein the total contact points area is related to the total area of the sandwich element in a ratio of less than 30 percent.

16. The element according to claim 15 wherein the said ratio is less than 15 percent.

17. The element according to claim 1 wherein the facing layer material is metal sheet.

18. The element according to claim 17 wherein the facing layer is steel.

19. The element according to claim 17 wherein the facing layer is aluminum.

20. The element according to claim 17 wherein the facing layer is wood sheet.

21. The element according to claim 1 wherein the contact points are plastic foam, plastic, metal or wood strips of a thickness of from 0.5 mm to 100 mm and a width from 10 mm to 100 mm.

22. The element according to claim 1 wherein the element is a door, a partition element or a construction unit.

23. The element according to claim 1 wherein the element is a clay brick or gypsum plaster stone.

* * * * *